US007311339B2

(12) United States Patent
Lau et al.

(10) Patent No.: US 7,311,339 B2
(45) Date of Patent: Dec. 25, 2007

(54) LATCHING SYSTEM AND METHOD

(75) Inventors: George H. K. Lau, Vancouver (CA); E. Wayne Thurber, Kelowna (CA); Todd O. Bolenback, Surrey (CA)

(73) Assignee: FPI, Fireplace International, L.L.C.

( * ) Notice: Subject to any disclaimer, the term of this patent is extended or adjusted under 35 U.S.C. 154(b) by 125 days.

(21) Appl. No.: 10/915,010

(22) Filed: Aug. 9, 2004

(65) Prior Publication Data

US 2005/0067841 A1 Mar. 31, 2005

Related U.S. Application Data

(60) Provisional application No. 60/493,709, filed on Aug. 8, 2003.

(51) Int. Cl.
*E05C 19/10* (2006.01)
*E05B 15/02* (2006.01)

(52) U.S. Cl. ..... 292/128; 292/336.3; 292/340

(58) Field of Classification Search ..... 292/95, 292/128, 121, 204, 209, DIG. 41, DIG. 71, 292/DIG. 61, 24, 29, 336.3
See application file for complete search history.

(56) References Cited

U.S. PATENT DOCUMENTS 2,044,500 A * 6/1936 Geske et al. ..... 292/254
2,741,505 A * 4/1956 Clark ..... 292/341.17
2,966,864 A * 1/1961 Weaver ..... 109/63.5
3,045,464 A * 7/1962 Braginetz ..... 70/144
3,514,142 A * 5/1970 Smith ..... 292/113
4,138,151 A 2/1979 Nakao
4,205,867 A 6/1980 Loikitz
4,951,981 A * 8/1990 Claar et al. ..... 292/216

OTHER PUBLICATIONS

Written Opinion from Canadian Patent Office for PCT/IB2004/002811, Feb. 7, 2005.
Written Opinion from WIPO, Geneva, Switzerland for PCT/IB2004/002811, Apr. 7, 2005.

* cited by examiner

*Primary Examiner*—Jennifer H. Gay
*Assistant Examiner*—Kristina R Gluchowski
(74) *Attorney, Agent, or Firm*—Snell & Wilmer LLP

(57) ABSTRACT

A latching system and method are provided for facilitating an easier and/or smoother latching of a locking mechanism, such as a latching and catching mechanism for use with the closing of doors. In accordance with an exemplary embodiment, an exemplary latching system comprises a catch device and a latch handle configured for maintaining closure of a door. To reduce or prevent any undesirable "kick-back" of the latch handle during closure of the door, the catch device can comprise a catch spring mechanism configured to facilitate engagement with the latch handle. To provide for a substantially even balance against the catch device and/or to provide for a substantially even pressure against a door gasket, the latch handle can comprise a latch spring mechanism configured to allow engagement of the latch handle to the catch device as well as facilitate engagement of the door during closure.

13 Claims, 8 Drawing Sheets

LATCHING SYSTEM AND METHOD

CROSS-REFERENCE TO RELATED APPLICATIONS

This application claims priority to U.S. Provisional Application No. 60/493,709, filed on Aug. 8, 2003, entitled "Latching System and Method" and having the same inventors, and hereby incorporated herein by reference.

FIELD OF INVENTION

The present invention relates to latching systems. More particularly, the present invention relates to a latching system and method for facilitating an easier and/or smoother latching of a locking mechanism, such as for use with the closing of doors.

BACKGROUND OF THE INVENTION

For conventional design of door locking mechanisms, such as that used on doors for wood stoves and the like, the options are generally limited to single-action latching systems or cam-style locking mechanisms. While both options can provide for closure and lock of a door, both have various disadvantages.

For example, for single-action latching systems, a catch device and a latch handle are provided for locking of the door. As the door is being closed by pressing the latch handle for engagement against the catch device, the single-action latching system tends to "kick-back" against the latch handle, often providing an uncomfortable feeling to the user. As a result, such single-action latching systems are typically closed slowly with deliberate effort to minimize the impact of any "kick-back" or other like action.

For cam-style locking mechanisms, a cam mechanism is provided in addition to the catch device and latch handle to provide for closure and locking. However, before locking can be achieved, the cam-style locking mechanism requires proper alignment of the cam mechanism in a particularly correct position to engage the catch device. This requires the user to suitably turn the latch handle and particularly orient the cam mechanism to an appropriate rotational position before the locking mechanism can be engaged.

In addition, both single-action latching systems and cam-style locking mechanisms have difficulty, or will not work altogether, in slamming the door shut, e.g., the door will tend to "bounce-back" and remain in an open position. Further, during the sealing of the door after locking, both single-action latching systems and cam-style locking mechanisms have problems due to the manner that a gasket surrounding the door is compressed.

SUMMARY OF THE INVENTION

In accordance with various aspects of the present invention, a latching system and method are provided for facilitating an easier and/or smoother latching of a locking mechanism, such as a latching and catching mechanism for use with the closing of doors. In accordance with an exemplary embodiment, an exemplary latching system comprises a catch device and a latch handle configured for maintaining closure of a door. To reduce or prevent any undesirable "kick-back" of the latch handle during closure of the door, the catch device can comprise a catch spring mechanism configured to facilitate engagement with the latch handle. To provide for a substantially even balance against the catch device and/or to provide for a substantially even pressure against a door gasket, the latch handle can comprise a latch spring mechanism configured to allow engagement of the latch handle to the catch device as well as facilitate engagement of the door during closure.

BRIEF DESCRIPTION OF THE DRAWINGS

The exemplary embodiments of the present invention will be described in conjunction with the appended drawing figures in which like numerals denote like elements and.

DETAILED DESCRIPTION OF EXEMPLARY EMBODIMENTS OF THE INVENTION

The present invention may be described herein in terms of various functional components. It should be appreciated that such functional components may be realized by any number of hardware components, such as springs, latches, pins and the like, configured to perform the specified functions. In addition, the present invention may be practiced in any number of latching or locking mechanism context and that the latching systems described herein are merely one exemplary application for the invention.

Figure 1:
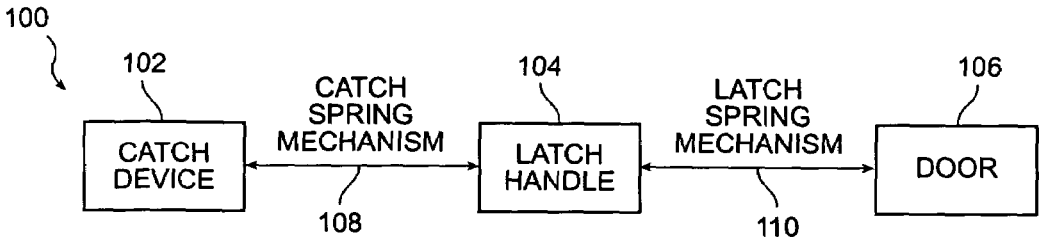
FIG. 1 illustrates a block diagram of an exemplary latching system in accordance with an exemplary embodiment of the present invention.

In accordance with various aspects of the present invention, a latching system and method are configured to provide for an easier and/or smoother latching of a locking mechanism, such as for use to enable the closure of doors. In accordance with an exemplary embodiment, with reference to a block diagram in FIG. 1, an exemplary latching system 100 comprises a catch device 102 and a latch handle 104 configured for latching and/or locking of a door 106. Catch device 102 is configured for providing a catching function, e.g., a latching and/or stopping function to a latching device or member, such as latch handle 104. To prevent any undesirable "kick back" of latch handle 104 during closure of door 106, catch device 102 can be configured with a catch spring mechanism 108 to engage latch handle 104. Catch spring mechanism 108 is configured to provide a pressure or force, e.g., a spring force, when catch device 102 becomes engaged by latch handle 104, and can comprise various types and sizes of pressure or spring devices and components, with various pressure or spring forces and/or elastic characteristics.

Latch handle 104 is configured for enabling the opening and closing of door 106, such as by providing for a latching function with catch device 102. In addition, to provide for a substantially even balance against catch device 102 and/or to provide for a substantially even pressure against a door gasket/frame member by door 106, latch handle 104 can also be configured with a latch spring mechanism 110 configured to allow engagement of latch handle 104 to catch device 102 as well as engage door 106 during closure, such as by urging the door against a door frame/gasket. Latch spring mechanism 110 is configured to provide a pressure or force, e.g., a spring force, when door 106 becomes engaged by latch handle 104, and can also comprise various types and sizes of pressure or spring devices and components, with various pressure or spring forces and/or elastic characteristics.

While an exemplary latching system 100 can be configured with both a catch spring mechanism 108 and a latch spring mechanism 110 in accordance with various embodiments, an exemplary latching system 100 can also be configured with only one of catch spring mechanism 108 or latch spring mechanism 110. In other words, while the combination can provide a suitable operation of latching system 100, catch spring mechanism 108 and latch spring mechanism 110 can independently operate to achieve the intended functions.

Figure 2A:
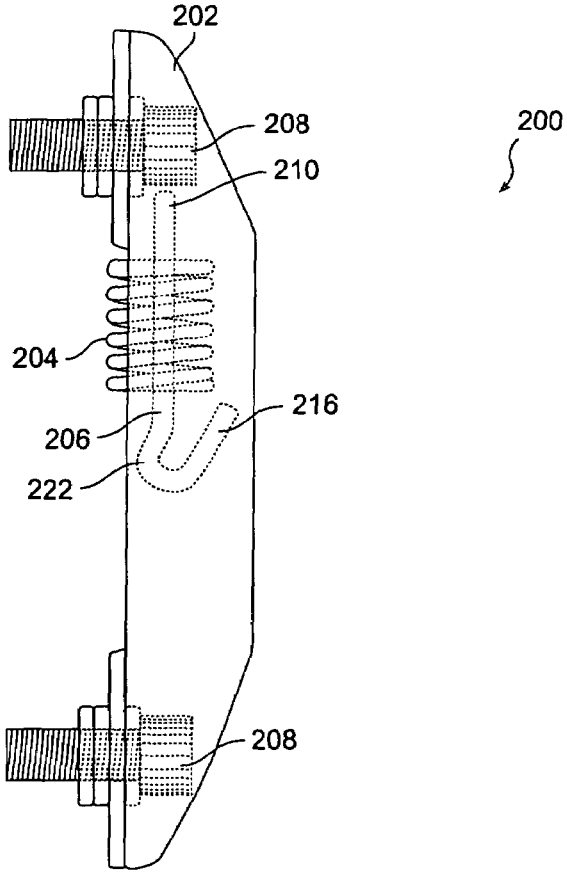
FIGS. 2A-2C illustrate side, front and top views of an exemplary catch device and catch spring mechanism in accordance with an exemplary embodiment of the present invention.
Figure 2B:
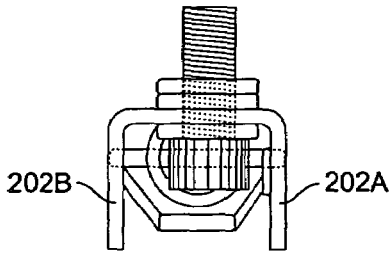
Figure 2C:
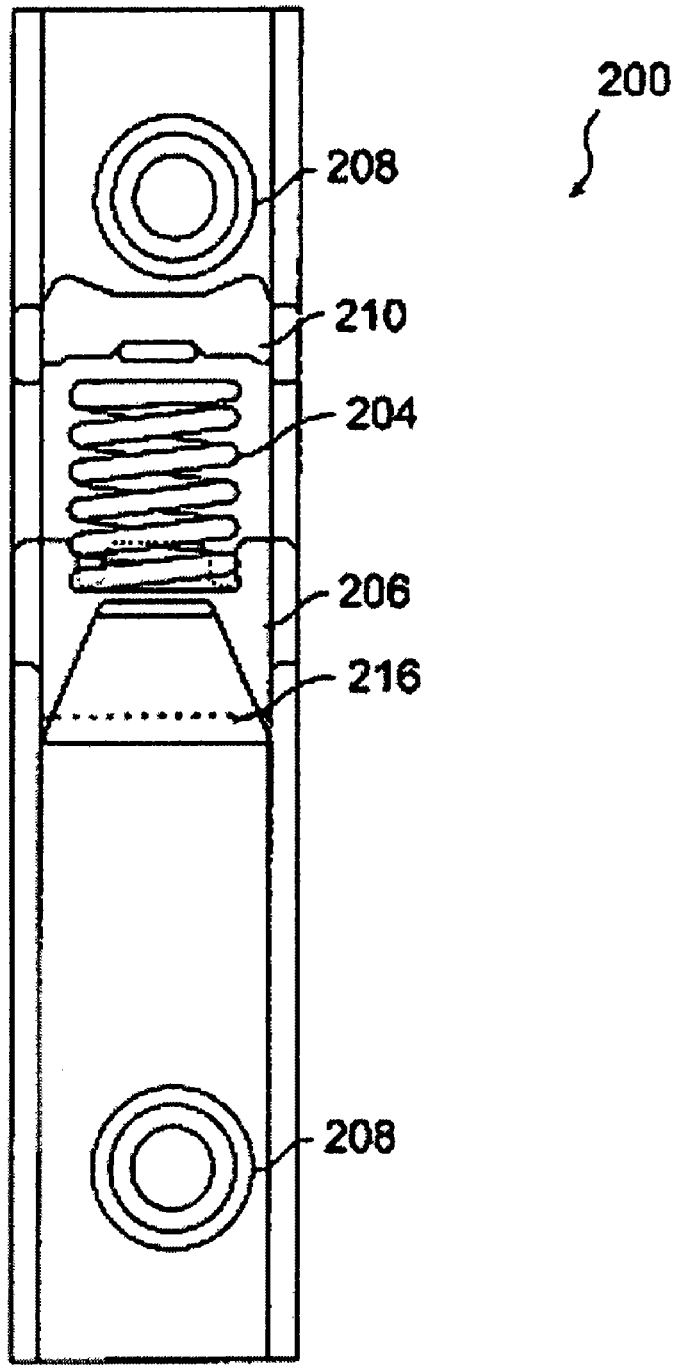
Figure 3:
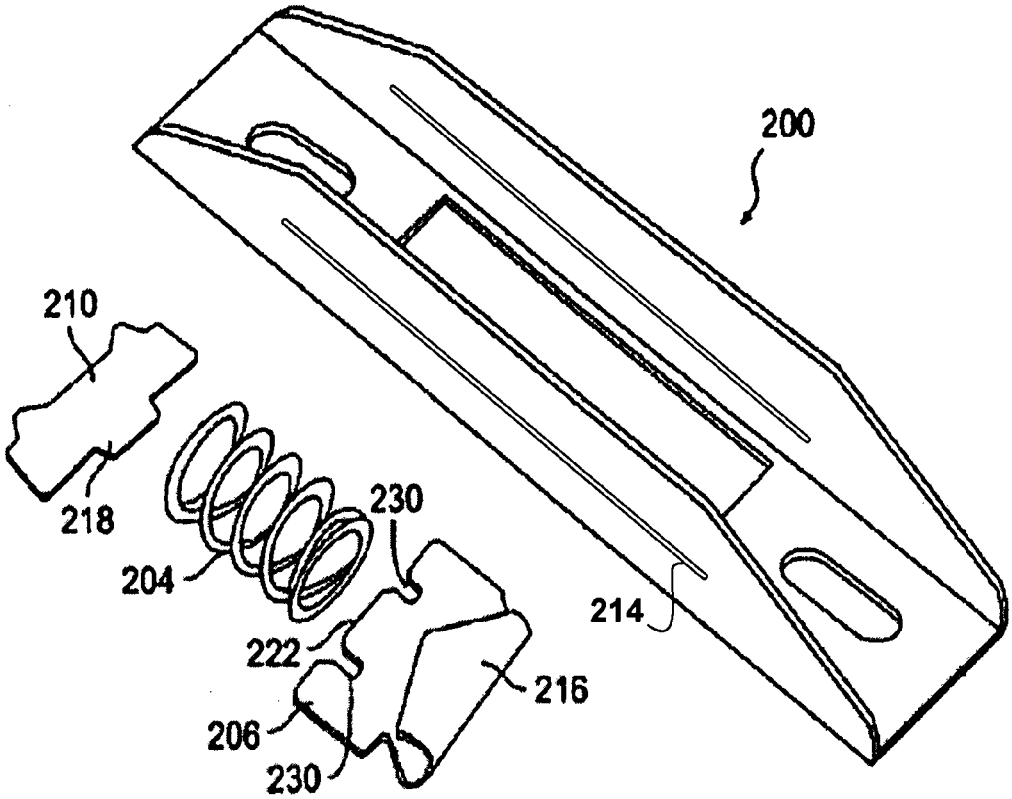
FIG. 3 illustrates an exploded view of an exemplary catch device and catch spring mechanism in accordance with an exemplary embodiment of the present invention.

Catch device 102 can be configured in various manners and arrangements for providing a catching, latching and/or stopping function to a locking/latching device or member. For example, with reference to FIGS. 2A-2C in accordance with an exemplary embodiment, a catch device 200 comprises a catch mount 202, a catch spring member 204, a spring-loaded catch 206 and a spring holder 210. Catch mount 202 is configured for mounting onto a doorframe and for maintaining catch spring member 204, spring-loaded catch 206 and spring holder 210 in position relative to a doorframe and a latch handle. Catch mount 202 can be affixed to a doorframe in various manners. For example, in accordance with an exemplary embodiment, with additional reference to FIG. 3, catch mount 202 can include a pair of openings 212 configured for interaction with a bolt, screw or other like attachment component, such as bolt and socket cap screw 208, for affixing to a doorframe. Openings 212 can be configured to allow for re-positioning of spring catch bar 202 prior to mounting on the doorframe, e.g., by having an oval configuration to allow for vertical positioning as illustrated, for horizontal positioning, or without any ability to re-position. Openings 212 can be of any suitably dimension, length and width configured to allow for re-positioning of catch mount 202. Catch mount 202 also comprises a slot 214 for maintaining position of catch spring member 204 within catch mount 202, and can be of any suitably dimension, length and width configured to maintain position of catch spring member 204. Catch mount 202 can also comprise various lengths, widths and thicknesses; in accordance with an exemplary embodiment, catch mount 202 can also comprise guides 202A and 202B for facilitating guided movement of catch spring member 204 and spring-loaded catch 206; however, catch mount 202 can also be configured without guides 218, or with any other configuration for maintaining relative position of catch spring member 204 and spring-loaded catch 206 during engagement with a latch handle.

Catch spring mechanism 108 is configured to prevent any undesirable kick back of latch handle 104 during closure of door 106. In an exemplary embodiment, catch spring mechanism 108 comprises catch spring member 204 configured within catch device 200. Catch spring mechanism 204 is configured to provide a pressure or force, e.g., a spring force, when door 106 becomes engaged by latch handle 104, and can also comprise various types and sizes of pressure or spring devices and components, with various pressure or spring, compression and elongation forces and/or elastic characteristics. For example, catch spring mechanism 204 can comprise a coiled spring member, a "zig-zag"-like spring member or any other mechanism or component configured for providing compression and elongation, having a spring force ranging from approximately 10 lbs to approximately 50 lbs, with a range of approximately 20 lbs to approximately 30 lbs suitable for many fireplace and stove applications.

Spring-loaded catch 206 and spring holder 210 are configured to maintain catch spring member 204 within catch mount 202. For example, with momentary reference again to FIG. 3, spring-loaded catch 206 and spring holder 210 can comprise engagement components 218 and 220 configured to maintain catch spring member 204 in between, when mounted within spring catch bar 202. Engagement components 218 and 220 can comprise various lengths, widths and dimensions for maintaining catch spring member 204 in between. In accordance with an exemplary embodiment, spring-loaded catch 206 can also comprise recessed portions 230 configured to maintain relative lateral position of catch spring member 204 within; however, spring-loaded catch 206 can also be suitably configured without recessed portions 230.

Catch spring member 204 can be suitably compressed by spring-loaded catch 206 and spring holder 210 to be suitably positioned within slot 214; once positioned within slot 214, catch spring member 204 can then suitably expand to urge spring-loaded catch 206 and spring holder 210 in position within slot 214. As a result, catch spring member 204, spring-loaded catch 206 and spring holder 210 can comprise a "free-floating" configuration to allow for tolerance and self-adjustment during the latching process.

To provide for a latching engagement with latch handle 104, spring-loaded catch 206 can also comprise a catching member 216 configured to engage with a latching member of latch handle 104. Catching member 216 is suitably configured to urge catch spring member 204 to a closed position when coming into contact with the latching member of latch handle 104. In the exemplary embodiment, catching member 216 comprises an angled "U"-shaped member with a curved-portion 222 configured to gradually urge catch spring member 204 to compress, and to apply expansion force against a latching member; however, various other configurations can be realized, such as "V"-shaped or other like configurations, with our without a curved-portion 222, that provide an engagement surface for interaction with a latching member of latch handle 104.

Figure 4:
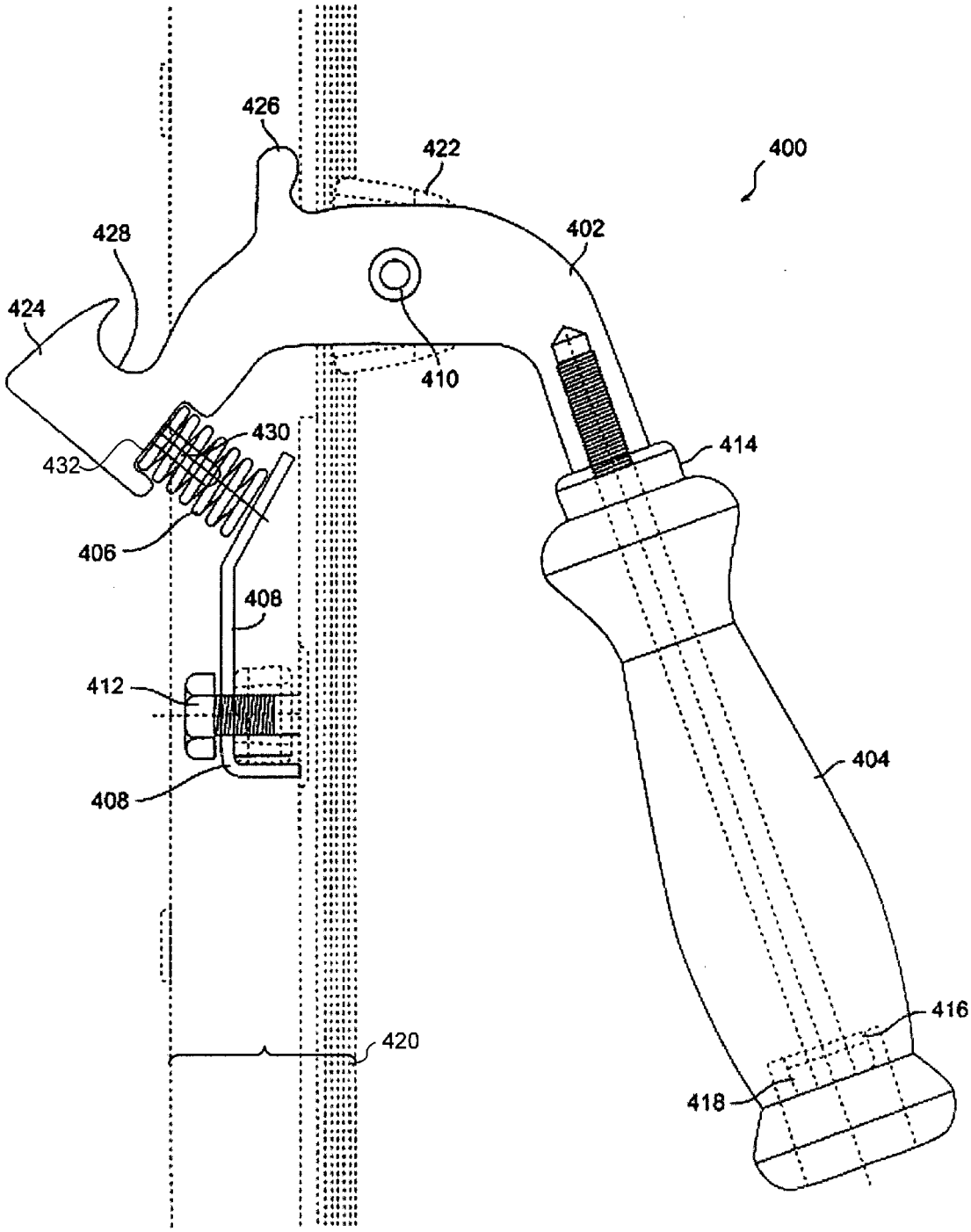
FIG. 4 illustrates a side view of an exemplary latch handle and latch spring mechanism in accordance with an exemplary embodiment of the present invention.

Latch handle 104 can be configured in various manners and arrangements for providing the opening and closing of door 106 and for providing a latching function with catch device 102. For example, with additional reference to FIG. 4, a latch handle assembly 400 can comprise a latch bar 402, a handle 404, and a latch spring member 406. Latch bar 402 comprises a latching member 424 configured for latching to catch device assembly 200. Latch bar 402 can be suitably mounted onto a door 420, e.g., to a pivot member 422, in various manners, such as through a spring tension pin 410, a bolt, bar or any other component configured to allow for latch bar 402 to suitably rotate about door 420. Such rotation can be configured for various ranges, for example, between approximately 5 degrees or any other angle that can enable door handle 404 to be pulled upwards up to 45 degrees or more of rotation.

In accordance with an exemplary embodiment, latching member 424 comprises a hook-shaped member 428 suitably configured for engagement with catching member 216 of spring-loaded catch 206. For example, hook-shaped member 428 can comprise a "U"-shaped member; however, latching member 424 can also comprise a "V"-shaped or other like-configuration member such that catching member 216 suitably resides or is contained within hooked member 428 when in a latched/closed position. To address the potential for latching member 424 to disengage due to thermal expansion when materials are heated to elevated temperatures, such as in a fireplace or stove, in accordance with an exemplary embodiment, hook-shaped member 428 may comprise a shape configured to seat catching member 216 such that any thermal expansion will not disengage latching member 424 and catching member 216, and may suitably secure catching member 206 within latching member 424. For example, hook-shaped member 428 can be configured with an inner shape comparable to the outer shape of catching member 216, e.g., both are "U"-shaped, "V"-shaped or other substantially identical shapes.

Door handle 404 is configured to enable operation by a user, and can be provided in various manners and sizes. For example, door handle 404 can comprise a rounded grip, or any other conventional handle configuration. In accordance with an exemplary embodiment, door handle 404 can be suitably attached to latch bar 402 through a bolt member 418 or any other attachment device, with or without a spacer 414 and a lock washer 416; accordingly, door handle 404 can be suitably mounted in any other manner. Moreover, in accordance with other exemplary embodiments, door handle 404 can comprise a single member with latch bar 402, i.e., door handle 404 and latch bar 402 can be suitably integrated from a single structure and material. In applications where door handle 404 and latch bar 402 are used in fireplaces, stoves or ovens, it is preferable that door handle 404 comprise a separate, wooden, non-metal or other like material that is not prone to conducting heat from latch bar 402. Door handle 404 can also be configured at various angles away from door 420, for example, from approximately 10 degrees or less during closure to 45 degrees or more to suitably open.

To provide for a substantially even balance against a catch device and/or to provide for a substantially even pressure against a gasket for a door frame, latch spring member 406 is suitably coupled between latch bar 402 and door 420 and is configured to allow engagement of latch handle assembly 400 to the catch device as well as engage door 420 during closure. Latch spring member 406 is configured to provide a pressure or force, e.g., a spring force, when door 420 becomes engaged by latch handle assembly 400, and can also comprise various types and sizes of pressure or spring devices and components, with various pressure or spring forces and/or elastic characteristics. For example, latch spring member 406 can comprise a coiled spring member, a "zig-zag"-like spring member or any other mechanism or component configured for providing compression and elongation, e.g., with a spring force from approximately 10 lbs to approximately 50 lbs, with a range of approximately 20 lbs to approximately 30 lbs suitable for many fireplace and stove applications.

For maintaining latch spring member 406 in a relatively fixed position, a spring support 408 can be suitably mounted onto door 420, such as by bolt and washer 412 or other like components, and configured to abut one end of latch spring member 406. In addition, latching member 424 can also comprise a protruding member 430 to interact with the opposing end of latch spring member 406 to suitably maintain in position between spring support 408 and latching member 424. While protruding member 430 is configured with latching member 424 in accordance with this exemplary embodiment, an exemplary protruding member can also be configured onto spring support 408 in addition to or instead of protruding member 430. In accordance with an exemplary embodiment, latching member 424 includes a recessed portion 432 configured to maintain a portion of latch spring member 406 within latching member 424 to restrict lateral movement of latch spring member 406; however, latching member 424 can also be configured without recessed portion 432, e.g., protruding member 430 can be suitably configured with a width that approximates the inner diameter of a coiled-spring member 406 such that lateral movement of latch spring member 406 is suitably minimized.

As latch spring member 406 is urged closed by latching member 424, such as by pulling upwards on door handle 404, spring support 408 will operate to maintain latch spring member 406 in position and to facilitate compression of latch spring member 406. As door handle 404 is released, latch spring member 406 will expand to force latch handle downward and towards door 420. To prevent door handle from being pushed up against door 420, door latch 402 can also comprise a door handle stop 426 configured to abut door 420 prior to door handle 404 coming into full contact with door 420. In addition, to prevent a full compression of latch spring member 406, the protruding members of latching member 424 and/or spring support 408 can be configured to limit compression, e.g., to approximately 90%, thus prolonging the usable life of latch spring member 406.

Latching system 400 can suitably be configured with various door configurations. For example, door 420 can comprise any door configuration that can utilize a latching mechanism or system. While various exemplary embodiments illustrate a latching system for use with a fireplace or stove door, the exemplary latching system and door are not limited to that configuration, and can comprise any latching and door application.

In an exemplary embodiment of the present invention, an exemplary method for actuating door 420 comprises interfacing an engagement mechanism with a coupling mechanism. In a continuing aspect of an exemplary embodiment to actuate door 420, an engagement mechanism comprises latch handle assembly 400 interfacing with a coupling mechanism comprising catch device 200, and disengaging latch handle assembly 400 from catch device 200.

Figure 5A:
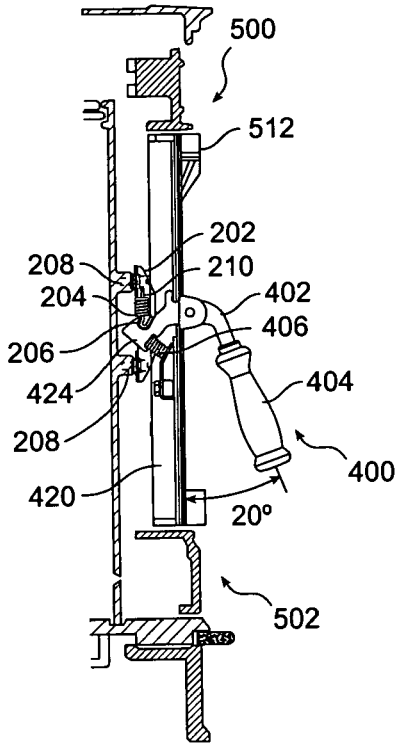
FIGS. 5A-5F illustrate operational views of an exemplary latching system in accordance with an exemplary embodiment of the present invention.
Figure 5B:
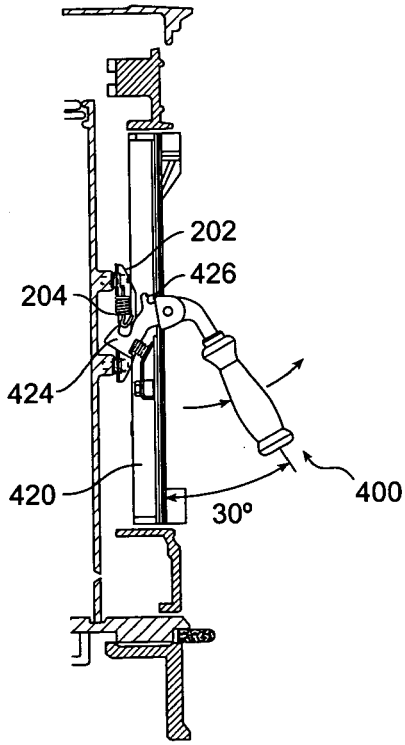
Figure 5C:
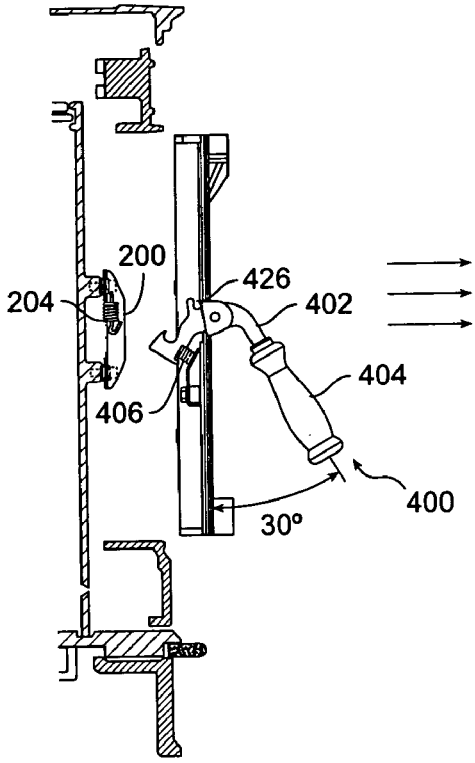
Figure 6:
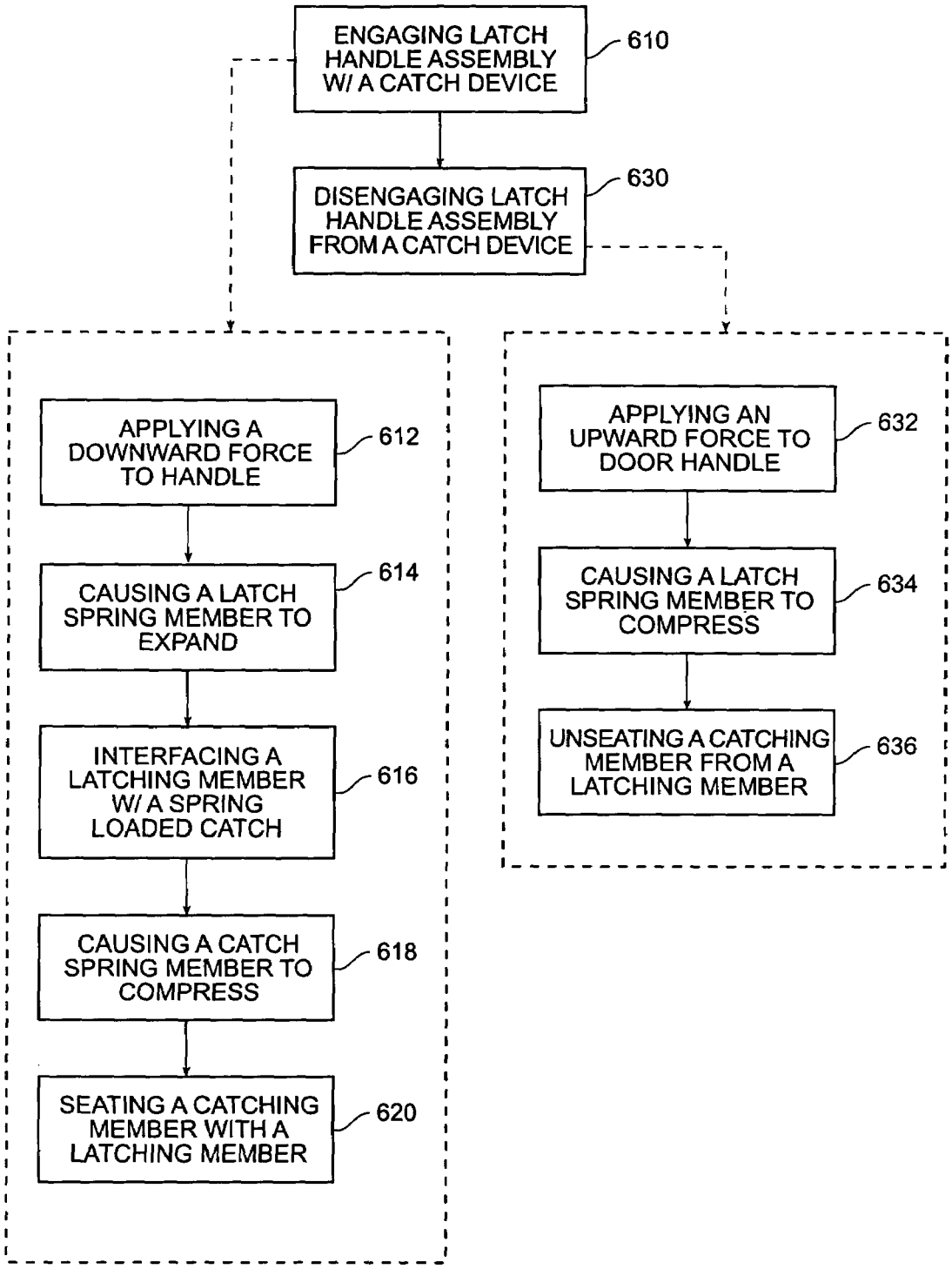
FIG. 6 illustrates a block diagram of an exemplary latching method in accordance with an exemplary embodiment of the present invention.

The various exemplary methods for actuating a latching system can be carried out in numerous manners. For example, for disengaging a latch handle 400 from a catch device 200, with reference to FIG. 5A, a latching system 500 is configured in a closed, engaged manner, it, with latching member 424 being engaged with catching member 216, e.g., catching member 216 being seated within latching member 424. Latch spring member 406 operates to maintain a substantially even pressure to a door gasket 512, such as by equalizing or balancing forces applied between catching member 216 and catch spring member 204, and between door 420 to a doorframe 502. To open door 420, with reference to FIG. 5B, door handle 404 can be suitably pulled outwards, e.g., door handle 404 can be pulled from approximately 20 degrees to approximately 30 degrees away from door frame, thus releasing latching member 424 from catching member 216 of catch device 200, and allowing door 420 to be fully opened, as illustrated in FIG. 5C. Accordingly, with additional reference to FIG. 6, a method for disengaging a latch handle from a catch device (630) comprises the applying an upward force to a door handle (632), causing a latch spring member to compress (634), and disengaging, e.g., unseating, a catch member from within the latching member (636).

Figure 5D:
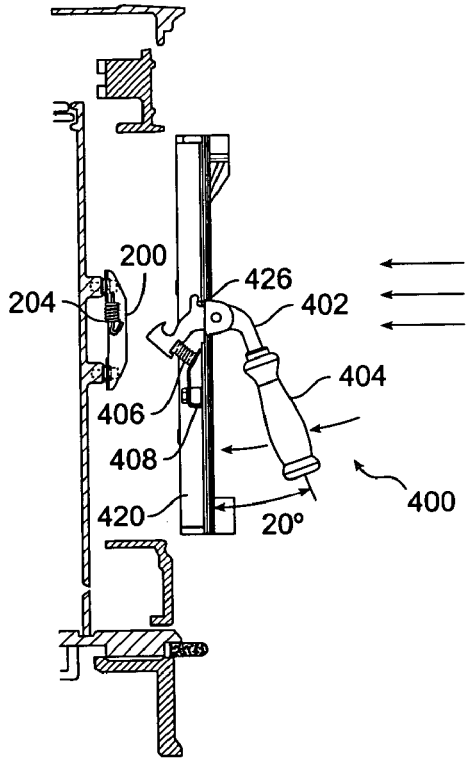
Figure 5E:
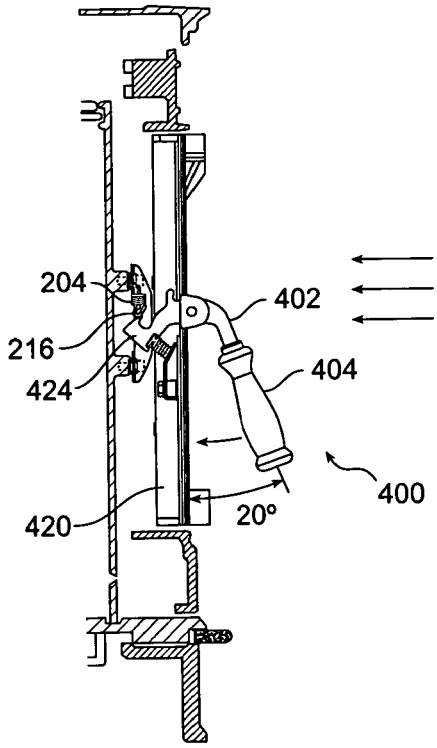
Figure 5F:
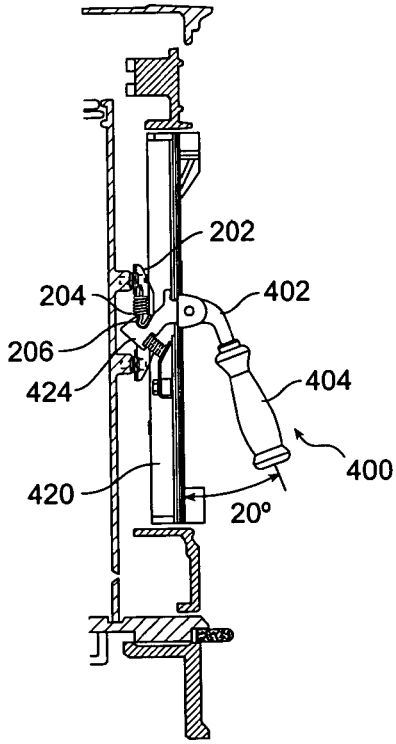

To provide for closure of door 420 through engaging of latch handle 400 with catch device 200, with reference to FIGS. 5D and 5E, a downward force can be applied to door handle 404, causing latch spring member 406 to expand between latching member 424 and spring support 408. Door 420 can be suitably closed with sufficient force enabling catch spring member 204 to be compressed, such as by latching member 424 urging catch member 216 to compressibly force spring-loaded catch 206. Although a downward force to door handle 404 can be applied to further expand latch spring member 406, the closure of the door can also be suitably initiated by simply applying a pressure to urge door 420 towards a doorframe, with the spring force of latch spring member 406 naturally expanding, thus pulling downwards to some extent on door handle 404. Upon catching member 216 interfacing with latching member 424, catch spring member 204 can be suitably compressed until catching member 216 becomes appropriately positioned or seated within latching member 424, as illustrated in FIG. 5F. Accordingly, with additional reference again to FIG. 6, actuating/latching a door comprises engaging a latch handle assembly with a catch device (610). To enable engagement between the latch handle assembly with the catch device, an exemplary method comprises applying a downward force to a latch handle (612), causing a latch spring member to expand, e.g., between a latching member and a spring support (614), interfacing said latching member with a spring loaded catch, e.g., a catching member (616), causing a catch spring member to compress (618) and seating the catching member within the latching member (620).

In addition to providing for a smoother and/or more efficient latching and closing of door, the exemplary latching system can also be configured to address high-temperature exposure. For example, the various components and devices can comprise materials suitably for higher temperatures, such as stainless steels or other high-temperature alloys. In addition, to facilitate serviceability and maintenance, the various components and devices can be arranged with minimal working parts, thus making such parts readily accessible for removal and fastening.

The present invention sets forth a latching system and method that are applicable to various latching applications. It will be understood that the foregoing description is of exemplary embodiments of the invention, and that the invention is not limited to the specific forms shown. Various modifications may be made in the design and arrangement of the elements set forth herein without departing from the scope of the invention. For example, the various components and devices can be connected together in various manners in addition to those illustrated in the exemplary embodiments. In addition, the catching devices and/or latching members can be configured to catch, latch, interlock or engage in any other arrangement, shape and configuration in addition to the "V" shaped configurations of the exemplary embodiments, for latching and/or catching. These and other changes or modifications are intended to be included within the scope of the present invention as set forth in the following claims.

We claim:

1. A latching system for a stove or fireplace door, said latching system comprising:

a doorframe;

a door;

a latch handle assembly coupled to said door, wherein said latch handle assembly comprises a latching member, wherein said latching member comprises a seat and a coil latch spring at one end of said latching member and a rotatable latch handle at the opposite end of said latching member; and a catch device coupled to said doorframe, wherein said catch device comprises a catch that slides into said seat, a catch spring which provides a sliding force for said catch, and a catch mount comprising a pair of slots, and a spring holder coupled to said catch spring that slides within said slots to guide said catch spring and said catch within said slots.

2. The latching system of claim 1, wherein said catch spring has a spring force from approximately 20 lbs to approximately 30 lbs.

3. The latching system of claim 1, wherein said catch further comprises a portion configured for engaging said latching member, wherein said portion allows said latching member to force said catch spring to compress upon engagement prior to seating said catch inside said seat of said latching member.

4. The latching system of claim 1, wherein said seat of said latching member comprises a hooked-shaped member.

5. The latching system of claim 4, wherein said seat of said latching member further comprises a configuration having an inner shape comparable to an outer shape of said catch to facilitate seating of said catch within said latching member.

6. The latching system of claim 5, wherein said latching member comprises a "U"-shaped seat configuration.

7. A method for latching and a method for unlatching a fireplace or stove door comprising:

applying a downward force to a latch handle assembly coupled to a door to urge said door towards said doorframe, wherein said latch handle assembly comprises a rotatable latch handle that applies a downward and an upward force, a latch bar coupled to said latch handle configured to pivot upon said application of said downward and an upward force, and a latching member comprising a seat, and a coil latch spring configured to provide pressure against said latching member;

forcing said door closed such that a portion of said latching member engages a catch device comprising a catch that slides into said seat and a catch spring which provides a sliding force for said catch, wherein said catch device is coupled to a doorframe with a catch mount comprising a pair of slots, and a spring holder coupled to said catch spring that slides within said slots to guide said catch spring and said catch within said slots;

continuing to force said door closed such that said catch is slid into said seat, thereby allowing said catch spring to expand and to secure said door to said doorframe.

8. The method of claim 7, further comprising:

applying an upward force to said latch handle assembly, thereby compressing said latch spring and freeing said seat from said catch, wherein said catch spring remains expanded; and pulling said latch handle such that said door is unlatched.

9. The method of claim 7, wherein said seat comprises a hooked-shaped member.

10. The method of claim 9, wherein said seat further comprises a configuration having an inner shape comparable to an outer shape of said catch to facilitate seating of said catch within said latching member.

11. A latching system for a stove or fireplace door, said latching system comprising:

a doorframe;

a door;

a latch handle assembly coupled to said door, wherein said latch handle assembly comprises a rotatable latching member configured to provide a seat;

a coil latch spring coupled to said latch handle assembly, wherein said latch spring is configured to expand upon seating said catch inside said seat of said latching member thereby maintaining said catch in said seat; and a catch device coupled to said doorframe, wherein said catch device comprises:

a catch that slides into said seat;

a catch spring which provides a sliding force for said catch, wherein said catch spring remains expanded upon opening said door thereby minimizing kickback; and a catch mount comprising a pair of slots and a spring holder coupled to said catch spring that slides within said slots to guide said catch spring and said catch within said slots.

12. The latching system of claim 11, further comprising a spring support coupled to said door configured to maintain said latch spring in a fixed position relative to said latching member.

13. The latching system of claim 12, wherein said latching member further comprises a protruding portion configured to limit the compression of said latch spring by contacting said spring support.

* * * * *